US010337723B1

(12) United States Patent
Marx

(10) Patent No.: US 10,337,723 B1
(45) Date of Patent: Jul. 2, 2019

(54) BAG SEARCH STICK AND METHOD OF USE

(71) Applicant: Eric Marx, New York, NY (US)

(72) Inventor: Eric Marx, New York, NY (US)

( * ) Notice: Subject to any disclaimer, the term of this patent is extended or adjusted under 35 U.S.C. 154(b) by 0 days.

(21) Appl. No.: 15/972,491

(22) Filed: May 7, 2018

(51) Int. Cl.

| | |
|---|---|
| ***F21V 33/00*** | (2006.01) |
| ***G08B 7/06*** | (2006.01) |
| ***F21L 4/00*** | (2006.01) |
| ***F21V 23/04*** | (2006.01) |

(52) U.S. Cl.
CPC ..... *F21V 33/0064* (2013.01); *F21L 4/00* (2013.01); *F21V 23/04* (2013.01); *G08B 7/06* (2013.01)

(58) Field of Classification Search
CPC ... F21L 4/00; F21L 4/005; F21L 4/027; F21L 4/045; F21V 23/04; F21V 23/0414; F21V 23/0421; F21V 23/0428; F21V 33/0064; G08B 7/00; G08B 7/06
USPC ..... 362/109, 119–120
See application file for complete search history.

(56) References Cited

U.S. PATENT DOCUMENTS 5,975,712 A * 11/1999 Shiao ..... B25B 23/18 362/120
8,523,379 B2 * 9/2013 Shay ..... F21L 4/005 362/157

FOREIGN PATENT DOCUMENTS

JP 08118872 A * 5/1996

* cited by examiner

*Primary Examiner* — Jason M Han
(74) *Attorney, Agent, or Firm* — Eldredge Law Firm; Richard G. Eldredge

(57) ABSTRACT

A bag search stick includes an elongated, cylindrical body extending from a first end to a second end; a lighting assembly to illuminate an inner cavity of a bag; and a control assembly having a switch and a power source, the switch to activate the lighting assembly and the power source to be recharged; the bag search stick is to be used during an inspection of the bag.

7 Claims, 3 Drawing Sheets

BAG SEARCH STICK AND METHOD OF USE

BACKGROUND

1. Field of the Invention

The present invention relates generally to systems and methods to search the inner cavity of a bag.

2. Description of Related Art

The process of searching bags during a bag inspection checkpoint is well known in the art. FIG. 1 is a front view of a conventional bag 101 having a body 103 that forms an inner cavity 105. When passing through a security checkpoint, the inspection typically places the hand within the bag and sifts through the content carried therein. One of the problems commonly associated with such procedures is that the inspector could come into contact with sharp dangerous object, e.g., needles, knives, broken glass from Meth pipes, and other potentially dangerous or unsanitary items. Further, another problem is that the bags are searched in areas wherein little to no light is provided for visual inspection. The inspector is required to inspect near a light and/or hold a flashlight and/or other similar means to inspect.

Great strides in the area of systems and method to inspect bags; however, many shortcomings remain. It is believed that the present system and method discussed herein overcomes the problems mentioned above.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
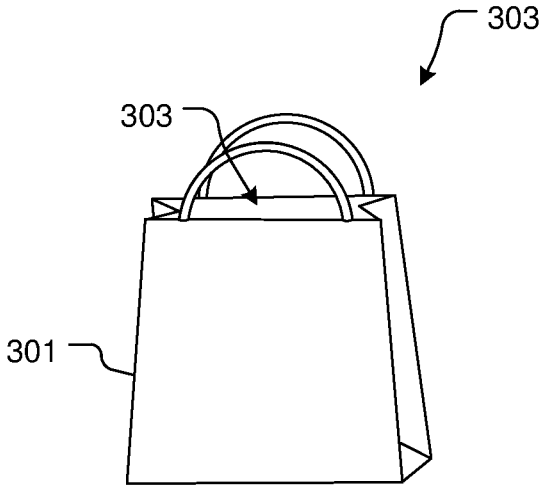
FIG. 1 (Prior Art)
FIG. 1 is a side view of a conventional bag for inspection.
Figure 2:
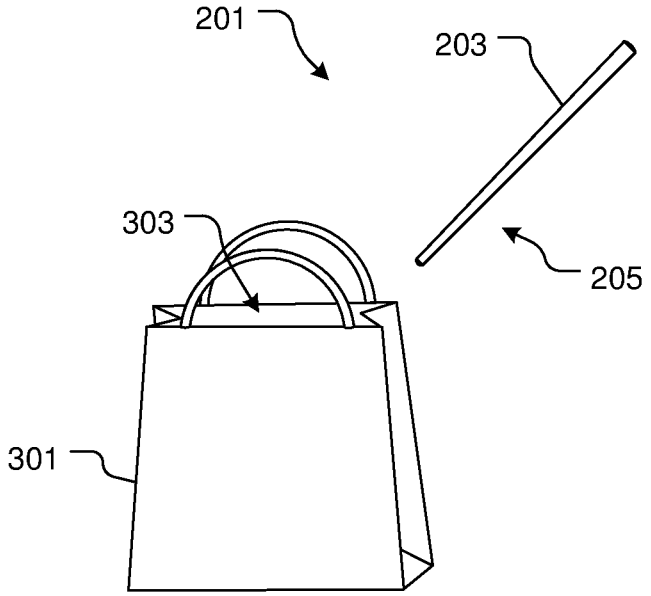
FIG. 2 is a side view of a system and method of use in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 2-6 depict various embodiments of a system and method of use in accordance to a preferred embodiment of the present invention. It should be understood that the embodiments discussed herein are substantially similar in form and function and share one or more of the features discussed in each embodiment although the features may not be shown specifically with reference to the particular embodiment.

In FIGS. 2-6 in the drawings, different views of a system 201 are shown utilized with bag 103. During use, the system 201 is configured to provide effective means to search bag 103 as will be described below. It is believed that system 201 overcomes the problems commonly associated with conventional means to search bags, as discussed above.

Figure 3:
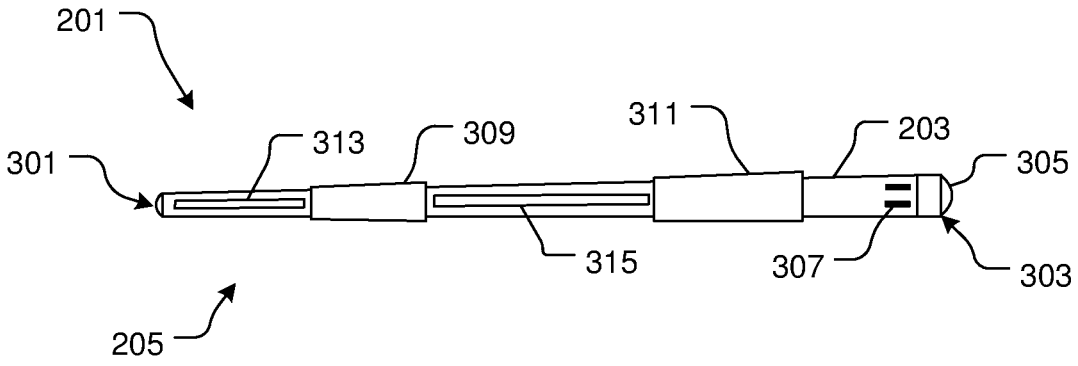
FIG. 3 is front side view of a search stick of the system of FIG. 2.
Figure 4:
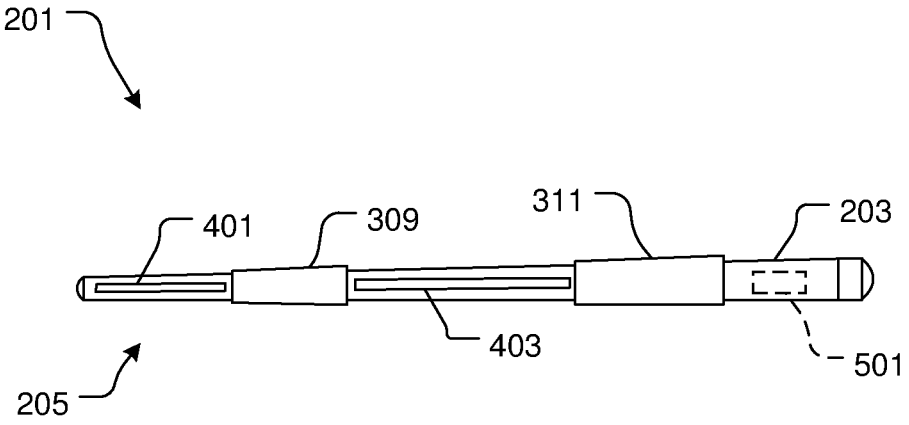
FIG. 4 is a back side view of the search stick of FIG. 3.

System 201 includes a search stick 203 having a lighting assembly 205 configured to illuminate the inner cavity 303 during the inspection. In FIGS. 3 and 4, details of the system 201 are further defined. The stick 203 extends from a first end 301 to a second end 303. In one preferred embodiment, the length from end-to-end is 18 inches; however, it will be appreciated that alternative embodiments could include different lengths in accordance to design choices. Further, in the preferred embodiment, the stick body is composed of a durable, weather resistant, black, ABS plastic or carbon fiber material. However, alternative embodiments could include different types of materials.

The search stick 203 is further provided with a switch 305 configured to manipulate the light intensity in addition to the type of light being utilized, as will be discussed below. The switch 305 is positioned at the second end 303 along with an electrical port 307 configured to received power from an external source to recharge battery 515. In one preferred embodiment, the electrical port 307 are electrical contacts adapted for contact with a base station batter recharger (not shown). However, it is contemplated that the ports could be other means for receiving electrical energy, e.g., a USB cable port.

The search stick 203 is also provided with one or more antibacterial, textured, rubber grips 309, 311 that extend around the periphery of the cylindrical body. In the preferred embodiment, two grips are utilized; however, more less grips could be used in an alternative embodiment.

One or the unique features believed characteristic of the present invention is the use of a lighting assembly 205 configured to illuminate the inner cavity of the bag during use. In the exemplary embodiment, four lights 313, 315, 401, and 403 are contemplated. The lights are positioned on opposing sides of the body and are separated by the grips, as shown in FIGS. 3 and 4. In one embodiment, a plurality of lights are utilized; however, it will be appreciated that the alternative embodiments could include a plurality of windows positioned at where lights 313, 315, 401, and 403 are located and in visual communication with a single light source disposed within the body of the search stick 203. Accordingly, the light stick could include a hollow cavity configured to store one or more lights therein. In one embodiment, the lights are white LED lights; however, it will be appreciated that the lights could be configured to illuminate in different wavelengths, e.g., a black light and/or other types. It will be appreciated that the switch 305 could be configured to interchange between the different types of lights.

Figure 5:
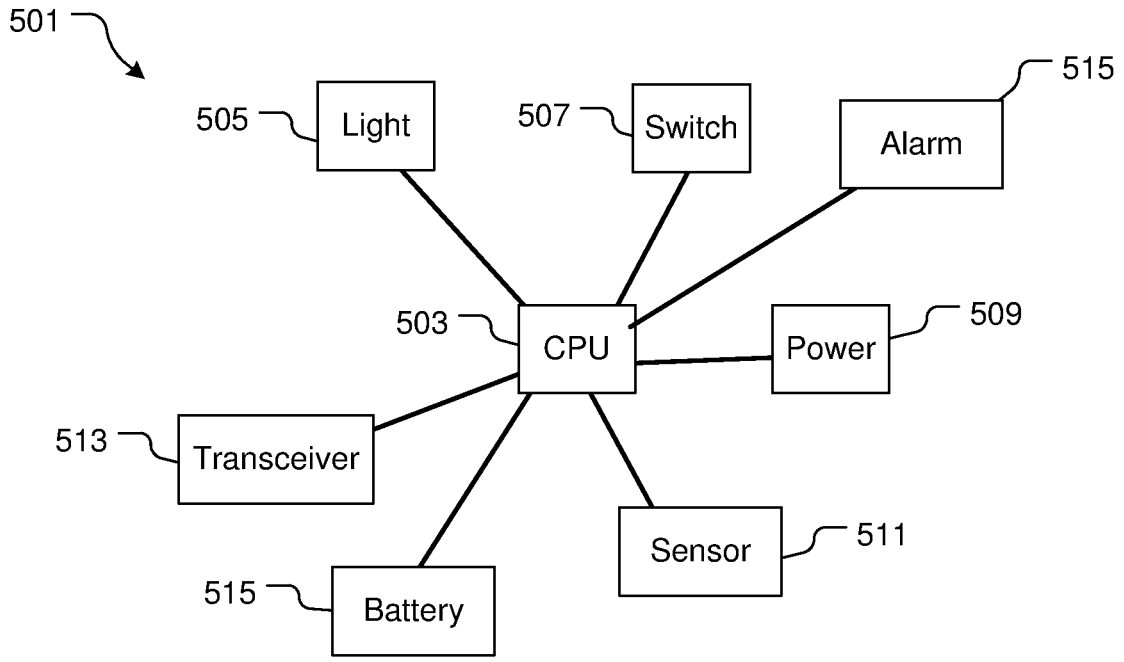
FIG. 5 is a simplified schematic of the control assembly of the system of FIG. 2.
Figure 6:
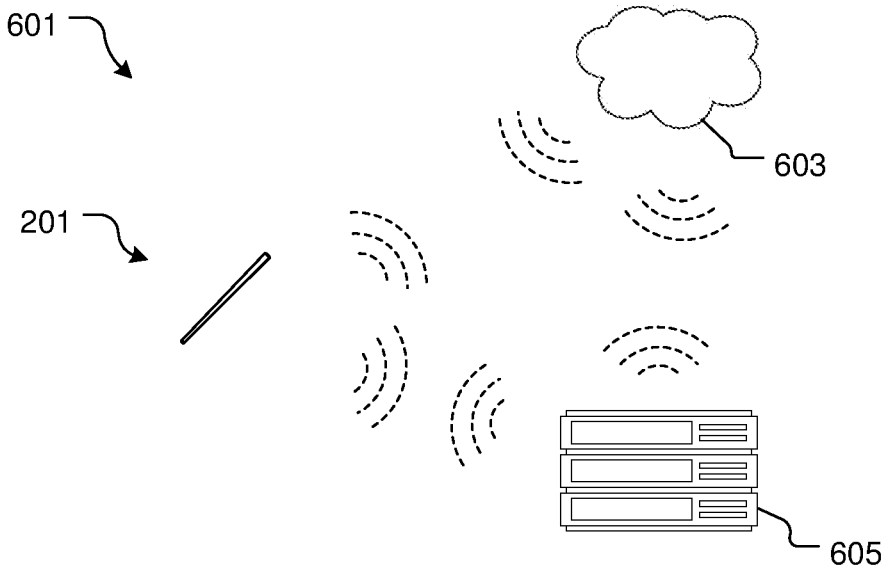
FIG. 6 is a simplified schematic of the communication system of the system of FIG. 2.

As shown in FIGS. 4 and 5, disposed within the body of the light stick 203 is a control assembly 501. The control assembly includes one or more of a CPU 503 conductively coupled to a light 505, switch 507, external power source 509, a sensor 511, a battery 515, and a transceiver 513. It will be appreciated that light 505 could the lighting assembly 205 and the switch 305 discussed above.

It is contemplated utilizing a sensor 511 that could be configured to detect harmful substances that are not always detected by the inspector. For example, a sensor could be used to detect the presence of narcotics, explosives, and the like. It is also contemplated utilizing a transceiver 513 and an alarm 515 for alerting other third parties. For example, a visual and/or audible alarm 515 could be activated in the event that harmful substances are detected.

In one embodiment, it is contemplated having a communication system 601 in data communication with the transceiver 513 of the search stick 203. In this embodiment, the communication system 601 could include a database 605 and a server 603 configured to communicate with each other and the search stick 203. This feature allows other third parties to be alerted of a potentially dangerous situation as the inspector conducts the search.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A bag search stick, comprising:

an elongated, cylindrical body extending from a first end to a second end;

a lighting assembly configured to illuminate an inner cavity of a bag; and a control assembly disposed within the elongated, cylindrical body, the control assembly having:

a switch and a power source, the switch configured to activate the lighting assembly and the power source configured to be recharged;

a computer;

a sensor conductively coupled to the computer, the sensor is configured to sense one or more substances within the inner cavity of the bag, and if detected, to relay the detection to the computer;

an alarm conductively coupled to the computer, the alarm is configured to activate upon detection of the one or more substances detected by the sensor; and a transceiver conductively coupled to the computer, the transceiver is configured to emit a signal upon detection of the one or more substances;

wherein the bag search stick is configured to be used during an inspection of the bag.

2. The stick of claim 1, wherein the body is approximately 18 inches from the first end to the second end.

3. The stick of claim 1, wherein the body is composed of an ABS plastic.

4. The stick of claim 1, wherein the body is composed of a carbon fiber material.

5. The stick of claim 1, further comprising:

an antibacterial and textured rubber grip surrounding a periphery of the body.

6. The stick of claim 1, further comprising:

a server and a database configured to communicate with the control assembly to receive and record data via the transceiver.

7. A method of searching a bag, the method comprising:

providing the bag search stick of claim 1;

activating the lighting assembly, wherein light is illuminated away from the elongated cylindrical body of the search stick;

grasping the second end of the bag search stick; and placing the first end of the bag search stick into a cavity of the bag;

wherein the lighting assembly provides illumination into the cavity of the bag for improved visibility of the cavity.

* * * * *